US006866399B2

(12) United States Patent
Eaton, Jr.

(10) Patent No.: US 6,866,399 B2
(45) Date of Patent: Mar. 15, 2005

(54) LIGHT FIXTURE EXTENDER

(76) Inventor: Glenn A. Eaton, Jr., 10345 NE. Knott St., Portland, OR (US) 97220

( * ) Notice: Subject to any disclaimer, the term of this patent is extended or adjusted under 35 U.S.C. 154(b) by 3 days.

(21) Appl. No.: 10/083,883

(22) Filed: Feb. 26, 2002

(65) Prior Publication Data

US 2003/0161149 A1 Aug. 28, 2003

(51) Int. Cl.[7] ..... F21V 29/00; F21V 3/00

(52) U.S. Cl. ..... 362/260; 362/294; 362/373; 362/363

(58) Field of Search ..... 362/147, 260, 362/264, 373, 294, 363, 404, 437

(56) References Cited

U.S. PATENT DOCUMENTS

| | | | | |
|---|---|---|---|---|
| 4,363,083 A | | 12/1982 | Tanaka et al. | |
| D287,407 S | | 12/1986 | Fujita et al. | |
| 4,763,233 A | | 8/1988 | Poyer | |
| 4,878,159 A | | 10/1989 | Blaisdell et al. | |
| 5,073,845 A | * | 12/1991 | Aubrey | 362/260 |
| 5,390,096 A | | 2/1995 | DeKleine et al. | |
| 5,546,291 A | | 8/1996 | Simes | |
| 6,068,388 A | | 5/2000 | Walker et al. | |
| 6,099,144 A | | 8/2000 | Klaus | |
| 6,511,209 B1 | * | 1/2003 | Chiang | 362/373 |

* cited by examiner

*Primary Examiner*—Y. My Quach-Lee
*Assistant Examiner*—Peggy A. Neils
(74) *Attorney, Agent, or Firm*—Kolisch Hartwell, P.C.

(57) ABSTRACT

A light fixture extender adapted to be interposed a base and a diffuser of a light fixture. The light fixture extender includes a first coupling region adapted to removably couple the extender with the base of the light fixture and a second coupling region adapted to removably couple the extender with the diffuser of the light fixture. The light fixture extender further includes an extension region extending between the first coupling region and the second coupling region configured to enable an extended-length light bulb to be contained within the diffuser. The extension region may include a plurality of vents.

23 Claims, 2 Drawing Sheets

LIGHT FIXTURE EXTENDER

FIELD OF THE INVENTION

The present invention relates generally to light fixtures and more particularly, to an extender for a light fixture.

BACKGROUND OF THE INVENTION

Typical light fixtures, such as ceiling fixtures, outdoor lighting, etc., generally include a base, a socket adapted to receive a light bulb, and a globe or diffuser. Typically, these fixtures are adapted to receive an incandescent light bulb. The incandescent light bulbs are typically of such a dimension that they may be received within the socket and extend outward into the globe. The dimensions of a typical incandescent light bulb enable the globe to be coupled to the base surrounding the light bulb.

Recently, compact fluorescent light bulbs have become popular. These compact fluorescent light bulbs typically have a longer operating life than an incandescent light bulb, and therefore, are desirable for use in standard light fixtures. Compact fluorescent light bulbs may be received within a conventional light fixture socket using known socket adapters.

However, the compact fluorescent light bulbs typically have different physical dimensions than an incandescent light bulb. Specifically, many of the popular and inexpensive compact fluorescent light bulbs are typically longer than incandescent light bulbs. The dimensional differences between an incandescent light bulb and a compact fluorescent light bulb may make it difficult to use a compact fluorescent light bulb in a standard light fixture. For example, the use of a compact fluorescent light bulb in a standard light fixture may prevent the coupling of the globe to the base of the light fixture because the globe does not extend down far enough to accommodate the extra length of the compact fluorescent light bulb. It should further be noted that even if the globe is able to accommodate the size of the compact fluorescent light bulb, the close quarters may cause the light bulb to overheat and prematurely bum out.

SUMMARY OF THE INVENTION

The present invention provides a light fixture extender adapted to be interposed a base and a diffuser of a light fixture. The light fixture extender includes a first coupling region adapted to removably couple the extender with the base of the light fixture and a second coupling region adapted to removably couple the extender with the diffuser of the light fixture. The light fixture extender further includes an extension region extending between the first coupling region and the second coupling region configured to enable an extended-length light bulb to be contained within the diffuser. In some embodiments, the extension region includes at least one vent to enable the use of a high heat-producing light bulb.

Many other features of the present invention will be understood upon making reference to the detailed description, and the accompanying sheets of drawings in which preferred embodiments incorporating the principles of this invention are disclosed as illustrative examples only.

DETAILED DESCRIPTION AND BEST MODE OF THE INVENTION

Figure 1:
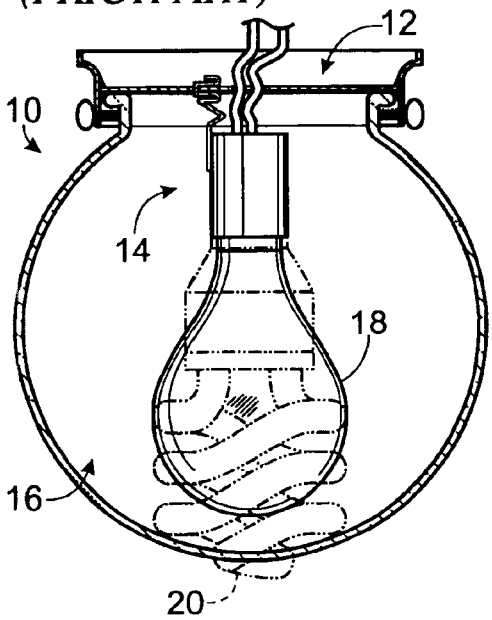
Fig. 1 (PRIOR ART)
FIG. 1 is a cross-sectional view of a conventional light fixture assembly having a base and a diffuser for a standard-length incandescent light bulb.

A typical light fixture is indicated generally at 10 in FIG. 1. Light fixture 10 includes a base 12, a socket 14 and a diffuser 16. A conventional incandescent bulb 18 is shown extending from socket 14. Diffuser 16 is coupled to base 12 such that incandescent bulb 18 is fully contained within diffuser 16 to produce an aesthetically pleasing light fixture. However, light fixture 10 may not accommodate all types of light bulbs. For example, an extended-length light bulb, such as compact fluorescent light bulb 20 shown in phantom lines in FIG. 1, may protrude beyond the bottom of diffuser 16 preventing diffuser 16 from properly fitting onto base 12.

Figure 2:
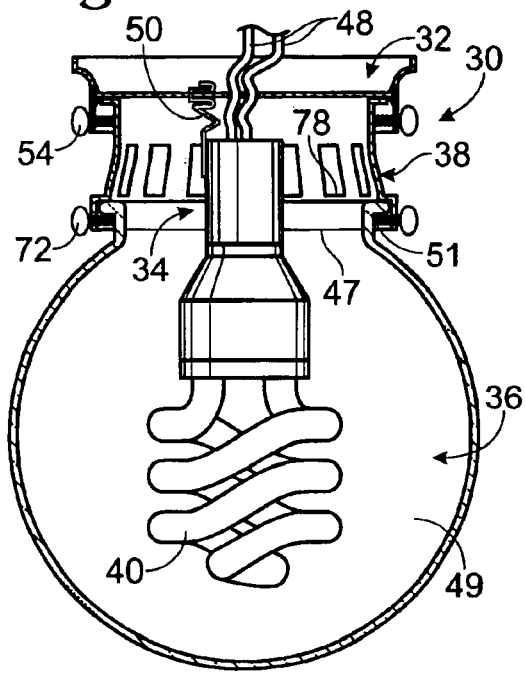
FIG. 2 is a cross-sectional view of a light fixture assembly having a base, an extender and a diffuser constructed in accordance with one embodiment of the present invention.

Turning now to FIG. 2, a light fixture assembly configured to accommodate the use of an extended-length light bulb is shown generally at 30. Light fixture assembly 30 includes a base 32, a socket 34, a diffuser 36, and a light fixture extender 38. Assembly 30 is configured to interchangeably accommodate a standard light bulb and an extended-length light bulb, such as a compact fluorescent light bulb 40. It should be noted that an extended-length light bulb exceeds the length of a standard light bulb. Furthermore, an extended-length light bulb, as used herein, may include any light bulb that exceeds the length of a light bulb intended for a specific light fixture. For example, if a light fixture typically accommodates a light bulb having a maximum length of 4.5 inches, then an extended-length light bulb would exceed the maximum length of 4.5 inches.

Figure 3:
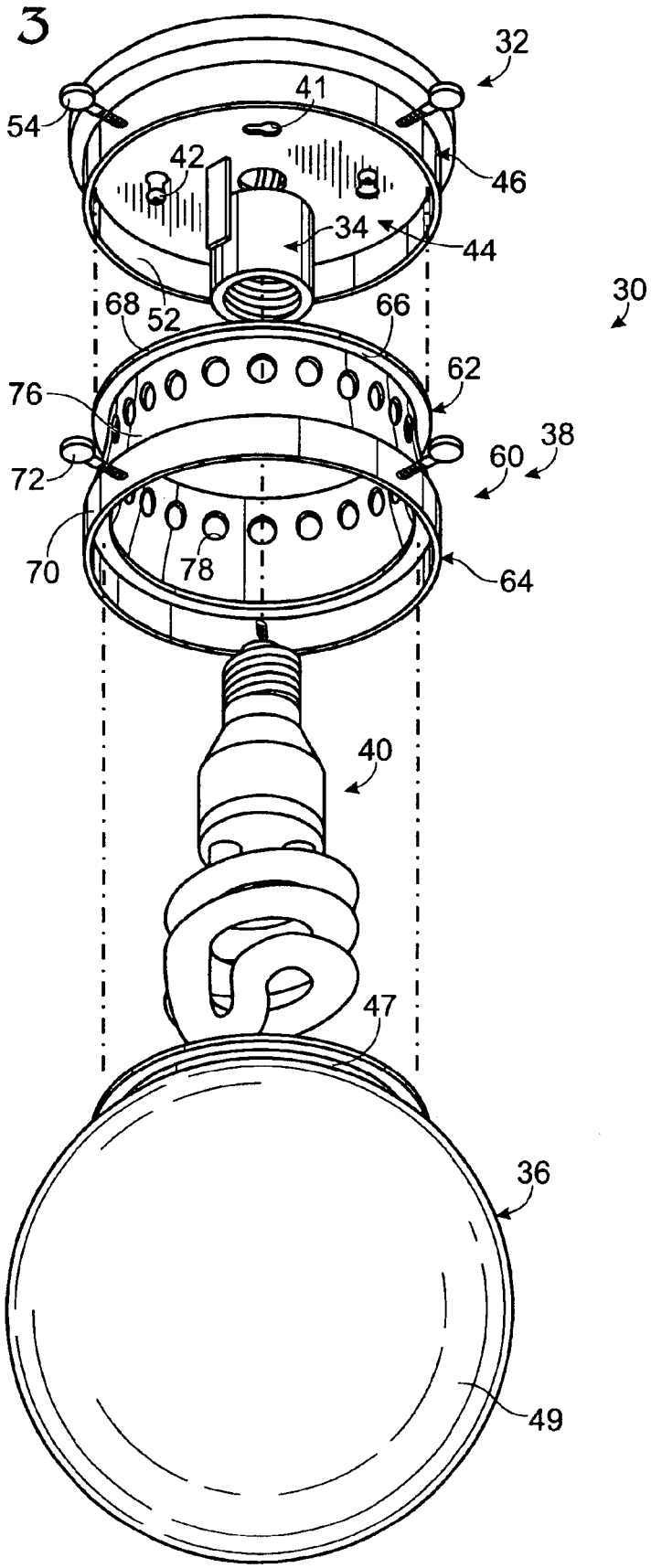
FIG. 3 is an exploded view of another light fixture assembly constructed in accordance with another embodiment of the present invention.

Referring now to both FIGS. 2 and 3, base 32 of fixture 30 is adapted to be mounted to any suitable mounting surface, such as a ceiling or wall. For example, base 32 may be mounted to an exterior surface. Alternatively, base 32 may be coupled to an interior surface, e.g. a hallway ceiling or wall, a bedroom ceiling or wall, a kitchen ceiling or wall, a laundry room ceiling or wall, etc. Thus, it should be appreciated that fixture 30 may be used both indoors and outdoors.

Base 32 may be attached to the mounting surface in any conventional manner using conventional fasteners, including, but not limited to, screws, nails, bolts, etc. For example, and as shown in FIG. 3, base 32 may include a plurality of holes 41 adapted to receive mounting screws 42. Mounting screws 42 may be screwed or otherwise secured to a mounting surface coupling base 32 to the mounting surface.

In the illustrated embodiment of FIG. 3, base 32 includes an inner portion 44 and an outer portion 46. Inner portion 44 is coupled with socket 34 and may be positioned such that socket 34 engages an electrical box and wires 48 (shown in FIG. 2) that provide power to socket 34. Inner portion 44 further may include a grounding mechanism as indicated by grounding wire 50.

Outer portion 46 of base 32, as shown in FIG. 3, is adapted to couple diffuser 36 or extender 38 to base 32. Diffuser or housing 36 is typically a globe that includes a mouth 47 of sufficient size to receive a light bulb. As best illustrated in FIG. 2, mouth 47 typically has a lip 51 adapted to engage base 32 or extender 38. Diffuser 36 further includes a rounded hollow portion or interior cavity 49 adapted to substantially surround a light bulb, such that the light is projected through the diffuser. Alternatively, diffuser 36 may be other geometric shapes having an interior cavity, including, but not limited to, cylinders, tetrahedrons, hexahedrons, octahedrons, etc.

As described briefly above, base 32 is adapted to receive either diffuser 36 or extender 38. Specifically, and as shown in FIG. 3, outer portion 46 of base 32 may include a collar or rim 52 with slots to receive couplers 54. Couplers 54 are adapted to contact and support diffuser 36 or extender 38. For example, in FIGS. 2 and 3, couplers 54 extend through collar 52 and adjustably engage the lip of diffuser 36 or extender 38, thereby supporting diffuser 36 or extender 38. In the illustrated embodiments, couplers 54 are shown as manually adjustable screws or thumbscrews, however it should be noted that any other suitable fasteners and securing mechanisms may be used.

As described briefly above, socket 34 is adapted to receive a light bulb. For example, socket 34 may be able to receive a standard light bulb or an extended-length light bulb, e.g. compact fluorescent light bulb 40. Use of compact fluorescent light bulb 40 or other type of extended-length light bulb within socket 34 may prohibit the direct coupling of diffuser 36 to base 34 due to the length of light bulb 40. However, insertion of extender 38 converts light fixture 30, such that an extended-length light bulb may be accommodated.

Extender 38 is adapted to be selectively attached and detached to light fixture 30 depending on the size and dimensions of the light bulb inserted and received within socket 34. For example, a user who connects a conventional incandescent light bulb to socket 34 may be able to directly couple diffuser 36 to base 32. Alternatively, a user who couples an extended-length bulb, such as compact fluorescent bulb 40, to socket 34, may accommodate the different dimensioned bulb by interposing light fixture extender 38 between base 32 and diffuser 36.

More specifically, extender 38 is adapted to be selectively interposed the base and diffuser of a light fixture. In a conventional light fixture, the diffuser extends directly from the base, such that it is a first distance from the base. Upon insertion of extender 38 between the base and diffuser, the distance between the diffuser and the base increases by the length of extender 38. By increasing the distance between the base and the mouth of the diffuser, a user may be able to use an extended-length light bulb in a conventional light fixture.

Extender 38 includes a body 60 that is substantially ring-shaped and includes a first coupling region 62 adapted to removably couple body 60 with base 32. First coupling region 62 includes a base mount 66. In the illustrated embodiment, base mount 66 includes a lip 68 configured to rest or hang from couplers 54. However, it should be noted that other configurations to support extender 38 are possible, including, but not limited to, screwing extender 38 into base 32, frictionally engaging extender 38, or otherwise locking extender 38 to base 32. In some embodiments, first coupling region 62 will be substantially identical in dimension and construction to the configuration of mouth 47 of diffuser 36, such that diffuser 36 and extender 38 may be interchangeably attached to base 32 using the same attachment and detachment mechanisms.

Extender 38 further includes a second coupling region 64 adapted to removably couple body 60 with diffuser 36. Second coupling region 64 includes a diffuser mount 70, which may take the form of a coupler 72, such as a thumbscrew. As illustrated, diffuser mount 70 is substantially identical to the configuration of outer portion 46 of base 32, such that the same diffuser may be attached in the same way to base 32 or diffuser mount 70 of extender 38. Such a configuration enables the same diffuser to be used with base 32 regardless of whether extender 38 is positioned within fixture 30 or not.

It further should be noted that extender 38 may be used to adapt a light fixture for use with a different-sized diffuser than is conventionally used with a specific light fixture. In other words, the dimensions of first coupling region 62 and second coupling region 64 may be varied to enable a user to couple different diffusers to different bases. Thus, in some embodiments, the first coupling region and second coupling region may be different sizes. For example, if an antique light fixture has a 4.0-inch base and is intended for use with a corresponding 4.0-inch mouth diffuser, an extender having a second coupling region adapted to receive a smaller or larger mouth diffuser may be used. Thus, it is possible with use of the extender, to attach a diffuser having a 5.0-inch mouth to the light fixture.

In one embodiment, diffuser mount 70 includes a collar or rim 74 and couplers 72 that are adapted to contact and support diffuser 36. For example, couplers 72, such as the thumbscrews, may extend through collar 74 such that each coupler individually engages diffuser 36, thereby supporting diffuser 36. Although three thumbscrews are illustrated, any number of thumbscrews may be used and are within the scope of the invention.

Extender 38 further includes an extension region 76 extending between first coupling region 62 and second coupling region 64. Extension region 76 may be of varied lengths, such that different types of extended-length bulbs may be accommodated within diffuser 36. In some embodiments, diffuser 36 may be of such size that extension region 76 may be minimal. In other embodiments, extension region 76 may be considerably longer. A user may be able to select different-sized extenders depending on the configuration of the light fixture and on aesthetics. For example, some users may desire to have more light in the lower more bulbous region of diffuser 36, and thus, an extender with a minimalized extension region may be most desired. Alternatively, other users may prefer to have more light towards the mouth of diffuser 36 and may choose an extender with a lengthened extension region. Regardless of the extender selected, the extender operates to enable the use of an extended-length light bulb, e.g. a compact fluorescent light bulb, within light fixture 30.

Extension region 76 further may include a plurality of vents 78. In some embodiments, the vents may function to allow air to circulate around the light bulb and dissipate heat from the light bulb. Such vents may increase the life of a compact fluorescent light bulb when used in a conventional light fixture. Thus, even if light fixture 30 is able to accommodate an extended-length light bulb, use of extender 38 within light fixture 30 may enable more air to circulate around the bulb diffusing any excess heat, and thereby, potentially extending the life period of the bulb. Moreover, in some embodiments, vents 78 may effectively increase the amount of light radiated from light fixture 30.

It has been observed that the life of a compact fluorescent light bulb or a high wattage light bulb is curtailed when such a bulb is used in a conventional fixture. Thus, even where the diffuser is able to accommodate the size of a compact fluorescent light bulb, the light bulb's life span is shortened when used in a conventional fixture due to the overheating of the light bulb. Specifically, the diffuser in a conventional fixture typically closes off the fixture prohibiting air from circulating around an attached light bulb. By providing vents 78 on extender 38, air is able to circulate around an attached light bulb and prevent the light bulb from overheating and prematurely burning out.

It should be noted that an extender 38 having vents 78 may be employed within a conventional light fixture with light bulbs that produce more heat than low wattage incandescent light bulbs typically used within such fixtures. For example, in a conventional light fixture adapted to receive a 60-watt light bulb, the extender may be used to accommodate not only an extended-length light bulb, but also a high heat-producing light bulb, regardless of the size of the bulb. A high heat-producing light bulb, as used herein, includes any light bulb that produces more heat than a conventional light bulb recommended for the fixture. For example, a high heat-producing light bulb may include a compact fluorescent light bulb, a higher wattage incandescent light bulb, a halogen bulb, or a self-ballasted mercury vapor light bulb. The vents within the extender prevent the overheating of the high heat-producing light bulb, thereby extending the life of the high heat-producing light bulb when used within a conventional light fixture.

Such vents may enhance the aesthetic appearance of light fixture 30. For example, light may reflect through vents 78 creating a light design or display on the mounting surface. Additionally, the vents themselves may be aesthetically appealing.

Figure 4:
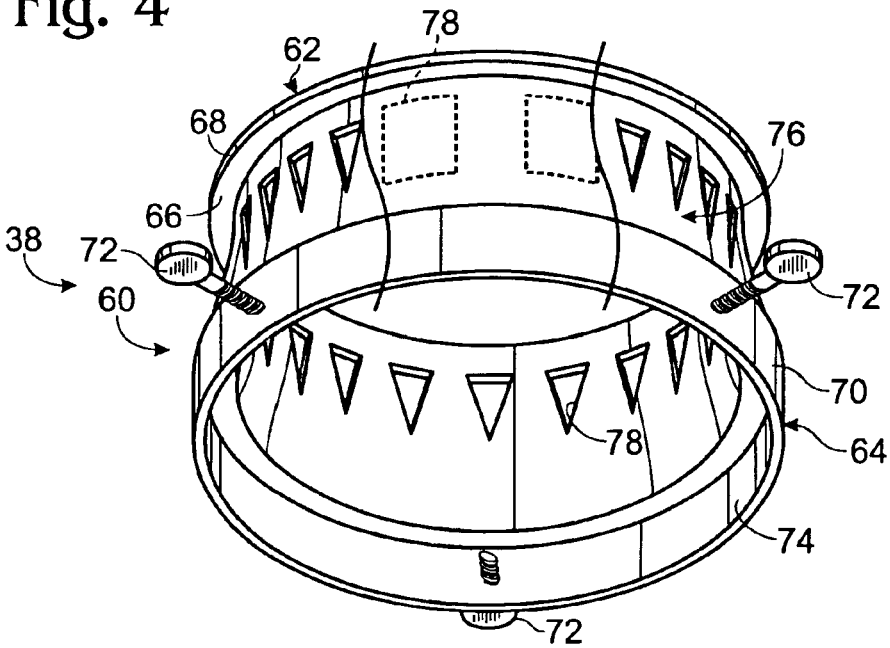
FIG. 4 is an isometric view of a light fixture extender constructed in accordance with one embodiment of the present invention.

Vents 78 may be of any shape or configuration. For example, vents 78 may be any number of specialty designs or patterns, including, but not limited to, rectangular designs (as shown in FIG. 2 and in phantom lines in FIG. 4), circular designs (as shown in FIG. 3), and/or triangular designs (as shown in FIG. 4). Moreover, the size, position, and number of vents 78 may vary without departing from the scope of the invention. It should further be noted that in some embodiments, extension region 76 may include little or no venting.

Extender 38 may be constructed from any suitable rigid material. For example, extender 38 may be formed from a single material or combination of materials, including, but not limited to, metal, brass, glass, etc. Additionally, extender 38 may be painted, textured, or otherwise coated to change the aesthetic appearance and qualities of the extender.

It further will be appreciated that numerous other embodiments, arrangement and modifications of extender 38 are possible and are within the scope of the invention. For example, it should be noted that extender 38 may incorporate any known coupling mechanism that functions to attach extender 38 to base 32 and diffuser 36. Moreover, extender 38 may be of any suitable length or construction to accommodate the use of any type of extended-length light bulb. It should further be noted that multiple extenders may be coupled together to produce an extended-length extender.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring, nor excluding, two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A light fixture extender adapted to be interposed a base and a diffuser of a light fixture, where the light fixture is configured to receive a light bulb; the light fixture extender comprising:

a first coupling region adapted to removably couple the extender with an outer portion of the base of the light fixture, wherein the outer portion of the base of the light fixture is spaced apart from the light bulb received within the light fixture such that the first coupling region is independent of the light bulb or a base of the light bulb;

a second coupling region adapted to removably couple the extender with the diffuser of the light fixture; and an extension region extending between the first coupling region and the second coupling region and configured to enable an extended-length light bulb to be contained within the diffuser.

2. The extender of claim 1, wherein the extended-length light bulb is a compact fluorescent light bulb.

3. The extender of claim 1, wherein the first coupling region includes a base mount having a lip adapted to engage a portion of the base of the light fixture.

4. The extender of claim 1, wherein the second coupling region includes a diffuser mount having at least one coupler configured to engage the diffuser.

5. The extender of claim 1, wherein the extension region includes a plurality of vents.

6. The extender of claim 5, wherein the plurality of vents are specialty designs.

7. The extender of claim 1, wherein the extension region is ring-shaped.

8. A light fixture assembly comprising:

a base having a rim, where the base is configured to be secured to a mounting surface;

a socket extending from the base and adapted to receive a light bulb, where the socket and the light bulb are independent of the rim of the base;

a diffuser sized to substantially surround the light bulb having a mouth of sufficient size to receive the light bulb into the diffuser, wherein the diffuser is adapted to be coupled with the rim of the base and extends a first distance from the base; and an extender removably interposed the base and the diffuser to extend the distance between the base and the mouth of the diffuser to accommodate a different-length light bulb.

9. The assembly of claim 8, wherein the extender comprises a first coupling region having a base mount adapted to selectively couple the extender to the rim of the base.

10. The assembly of claim 9, wherein the first coupling region and the mouth of the diffuser are substantially identical.

11. The assembly of claim 8, wherein the extender comprises a second coupling region having a diffuser mount adapted to selectively couple the diffuser to the extender.

12. The assembly of claim 8, wherein the extender includes an extension region having at least one vent.

13. The assembly of claim 8, wherein the different-length light bulb is a compact fluorescent light bulb.

14. A light fixture extender for a light fixture configured for a first light bulb of a first length, the fixture having a base and a diffuser, the extender comprising:

a base mount configured to selectively attach the extender to the base of the fixture without engaging a light bulb or a base of a light bulb received within the light fixture;

a diffuser mount configured to selectively attach the extender to the diffuser; and an extension region extending between the base mount and the diffuser mount configured to adjust the position of the diffuser relative to the base, in order to accommodate a second light bulb of a second length, wherein the length of the second light bulb exceeds the length of the first light bulb.

15. The extender of claim 14, wherein the second light bulb is a compact fluorescent light bulb.

16. The extender of claim 15, wherein the diffuser mount includes at least one coupler adapted to engage and support the diffuser.

17. The extender of claim 15, wherein the extension region includes a plurality of vents.

18. A light fixture extender adapted to be interposed a base and a diffuser of a light fixture; the light fixture extender comprising:

a first coupling region adapted to removably couple the extender with the base of the light fixture such that the extender independent of and not in contact with a light bulb received within the light fixture;

a second coupling region adapted to removably couple the extender with the diffuser of the light fixture; and an extension region extending between the first coupling region and the second coupling region, wherein the extension region includes a plurality of vents configured to allow air to circulate around a high heat-producing light bulb, thereby extending the life of the high heat-producing light bulb when the high heat-producing light bulb is used within the light fixture.

19. An extender for a light fixture assembly where the light fixture assembly includes a base having a rim, where the base is configured to be secured to a mounting surface, a socket extending from the base and adapted to receive a light bulb, where the socket and the light bulb are independent of the rim of the base; and a diffuser sized to substantially surround the light bulb having a mouth of sufficient size to receive the light bulb into the diffuser, wherein the diffuser is adapted to be coupled with the rim of the base and extends a first distance from the base; the extender comprising:

a first coupling region adapted to removably couple the extender with the rim of the base of the light fixture;

a second coupling region adapted to removably couple the extender with the diffuser; and an extension region to extend the distance between the base of the light fixture and the mouth of the diffuser to accommodate a different-length light bulb.

20. The extender of claim 19, wherein the first coupling region is substantially identical to the mouth of the diffuser.

21. The extender of claim 19, wherein the extension region has at least one vent.

22. The extender of claim 19, wherein the different-length light bulb is a compact fluorescent light bulb.

23. The extender of claim 19, wherein the extender includes a plurality of specialty-design vents.

* * * * *